US010758098B2

(12) United States Patent
Gharibian et al.

(10) Patent No.: US 10,758,098 B2
(45) Date of Patent: Sep. 1, 2020

(54) TOILET HOOK

(71) Applicant: MUNCHKIN, INC., Van Nuys, CA (US)

(72) Inventors: Nairi Gharibian, Glendale, CA (US); Jasper H Cohen, Jersey City, NJ (US)

(73) Assignee: Munchkin, Inc., Van Nuys, CA (US)

( * ) Notice: Subject to any disclaimer, the term of this patent is extended or adjusted under 35 U.S.C. 154(b) by 0 days.

(21) Appl. No.: 15/953,119

(22) Filed: Apr. 13, 2018

(65) Prior Publication Data

US 2019/0191945 A1 Jun. 27, 2019

Related U.S. Application Data

(60) Provisional application No. 62/609,944, filed on Dec. 22, 2017.

(51) Int. Cl.
*A47K 17/00* (2006.01)

(52) U.S. Cl.
CPC ..... *A47K 17/003* (2013.01)

(58) Field of Classification Search
CPC ..... A47K 17/003
USPC ..... 4/661
See application file for complete search history.

(56) References Cited

U.S. PATENT DOCUMENTS 3,799,467 A * 3/1974 Bauman ..... A47K 10/3836 242/560
4,638,515 A * 1/1987 Caputo ..... A47K 13/245 292/254
5,605,250 A * 2/1997 Meiron ..... A47K 10/38 221/33
5,732,416 A * 3/1998 Albert ..... A47K 13/24 4/300.3
5,881,400 A * 3/1999 Arnold ..... E03D 1/30 4/353
6,096,698 A * 8/2000 Milling ..... A01N 25/34 252/301.4 R
6,842,916 B1 * 1/2005 Gunn ..... A47K 13/105 4/246.1
6,937,155 B2 * 8/2005 Ballard ..... G08B 3/10 340/573.1
7,128,235 B2 * 10/2006 Haddad ..... A47K 10/42 221/45
D535,111 S * 1/2007 Giampavolo ..... A47K 11/04 D6/328
7,611,034 B1 * 11/2009 Peterson ..... A47G 25/743 211/115
7,882,968 B2 * 2/2011 Galt ..... A47K 13/06 211/106.01
D649,019 S * 11/2011 Kim ..... A47K 11/04 D8/367
D649,020 S * 11/2011 Kim ..... A47K 11/04 D8/367
D661,574 S * 6/2012 Platt ..... D8/367
8,256,035 B1 * 9/2012 Eguchi ..... A47K 13/105 4/246.1

(Continued)

*Primary Examiner* — Lori L Baker
(74) *Attorney, Agent, or Firm* — Robert Z. Evora, Esq.

(57) ABSTRACT

A toilet hook for use in storing a child's toilet seat cover. The toilet hook may have an upper body and a stopper attached to the upper body. The toilet hook may also have a lower body and a hook adjacent to the lower body. The upper body of the toilet hook may be able to twist in relation to the lower body.

20 Claims, 11 Drawing Sheets

(56) References Cited

U.S. PATENT DOCUMENTS 8,495,771 B1 * 7/2013 Damman ..... A47K 11/04 4/479
8,689,367 B2 * 4/2014 Nguyen ..... A47K 13/105 4/246.1
8,915,384 B2 * 12/2014 Immerman ..... A47K 10/04 211/119
8,966,674 B2 * 3/2015 Lu ..... C11D 17/0056 4/223
9,334,640 B2 * 5/2016 Burt ..... E03D 9/007
9,445,698 B2 * 9/2016 Pagett ..... A47K 13/105
9,644,359 B2 * 5/2017 Burt ..... A61L 9/048
D789,485 S * 6/2017 Hale ..... D23/208
D849,516 S * 5/2019 Johnson ..... D8/367
2006/0137081 A1 * 6/2006 Ferrara ..... E03D 9/032 4/231
2009/0235443 A1 * 9/2009 Arora ..... A61L 9/05 4/231
2010/0192291 A1 * 8/2010 Burt ..... E03D 9/007 4/223
2011/0209276 A1 * 9/2011 Lu ..... C11D 17/0056 4/223
2012/0266920 A1 * 10/2012 Burt ..... E03D 9/005 134/24
2013/0104304 A1 * 5/2013 Wilson ..... E03D 9/032 4/231
2013/0198945 A1 * 8/2013 McGowan ..... E03D 1/14 4/415
2013/0276220 A1 * 10/2013 Cogswell ..... E03D 9/052 4/352
2015/0000023 A1 * 1/2015 Massey ..... A61F 5/453 4/301
2015/0101114 A1 * 4/2015 Pagett ..... A47K 13/105 4/246.3
2015/0159358 A1 * 6/2015 Burt ..... A61L 9/048 4/231
2015/0376888 A1 * 12/2015 Chery ..... E03D 13/007 4/301

* cited by examiner

TOILET HOOK

CROSS REFERENCE TO RELATED APPLICATION

This application claims priority to U.S. Provisional Application Ser. No. 62/609,944 filed Dec. 22, 2017, the contents of which are hereby incorporated by reference herein in their entirety into this disclosure.

TECHNICAL FIELD

The subject disclosure relates to a toilet hook used for holding a child's toilet seat. More specifically, to a flexible toilet hook capable of supporting and storing a child's toilet seat.

SUMMARY

A toilet hook having a lower body and an upper body. The toilet hook may have a stopper attached to the upper body and a hook adjacent to the lower body. The upper body of the toilet hook may be rotated relative to the lower body. The toilet hook can be installed adjacent to a toilet tank and underneath a toilet tank cover. When installed underneath the toilet tank cover, the toilet hook may be able to support and store a child's toilet seat cover. Furthermore, the toilet hook may be able to twist to allow a user to easily install and remove the toilet seat cover.

BACKGROUND

Various toilet holding mechanisms have been provided for use alongside a toilet tank.

Each of these conventional toilet holders requires cumbersome techniques overcome by the disclosure below. Despite the ineffectiveness of these conventional attempts to provide a toilet hook, a need exists for a low cost, simple and efficient toilet hook that can be conveniently accessed.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION

Particular embodiments of the present invention will now be described in greater detail with reference to the figures.

Figure 1:
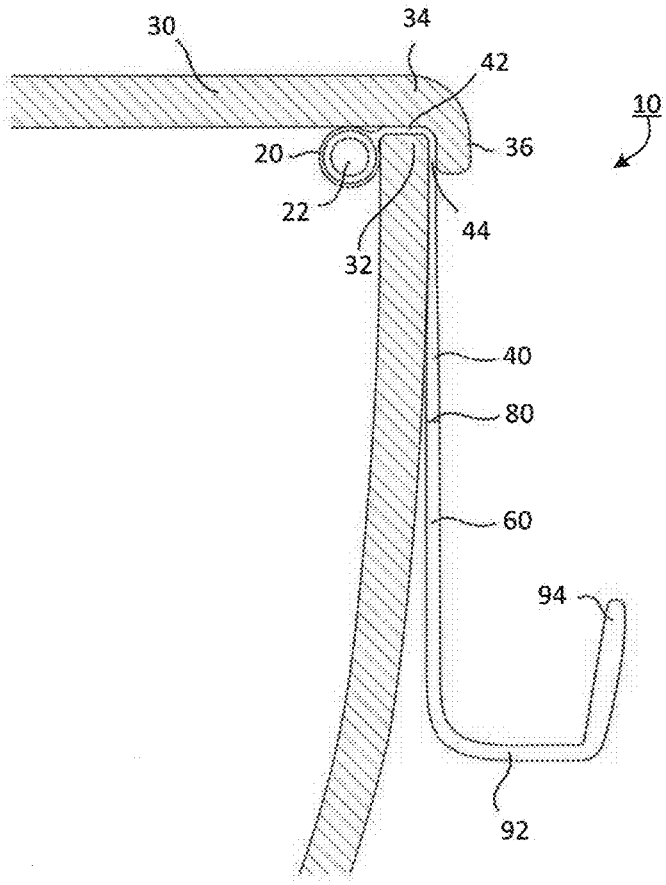
FIG. 1 illustrates an installed position of a toilet hook onto a toilet tank according to the subject disclosure.

FIG. 1 illustrates an embodiment of a device or toilet hook 10 according to this subject disclosure may include a stopper 20, a first section or an upper body 40 and a second section of a lower body 60. The first section 40 being capable of being flexibly twisted relative to the second section about a longitudinal axis.

FIG. 1 depicts the stopper 20 in use. The stopper 20 may contain an intermediate portion 22, which creates the wider width of the stopper 20 in relation to the upper body 40 and the lower body 60. While in an installed position, the stopper 20 becomes lodged against a toilet tank 32 of a toilet 30 and a toilet tank cover 34 of the toilet 30. Modern day toilet tank covers 34 have sufficient weight to prevent the stopper 20 from dislodging from under the toilet tank cover 34 and subsequently falling out. Thus, the stopper 20 and the toilet tank cover 34 provide support for the toilet hook 10 and create an anchoring effect.

FIG. 1 demonstrates that the upper body 40 is made of a flexible material that allows for manipulation and compression. Due to the flexible material, the upper body 40 can be twisted and compressed to allow for easy installation of the toilet hook 10. In an embodiment, the upper body 40 may be made of thermoplastic elastomers (TPE), but it is to be understood that the upper body 40 may be made of any flexible and/or resilient material, including, but not limited to, silicone, rubber and other similar plastic materials.

Figure 2:
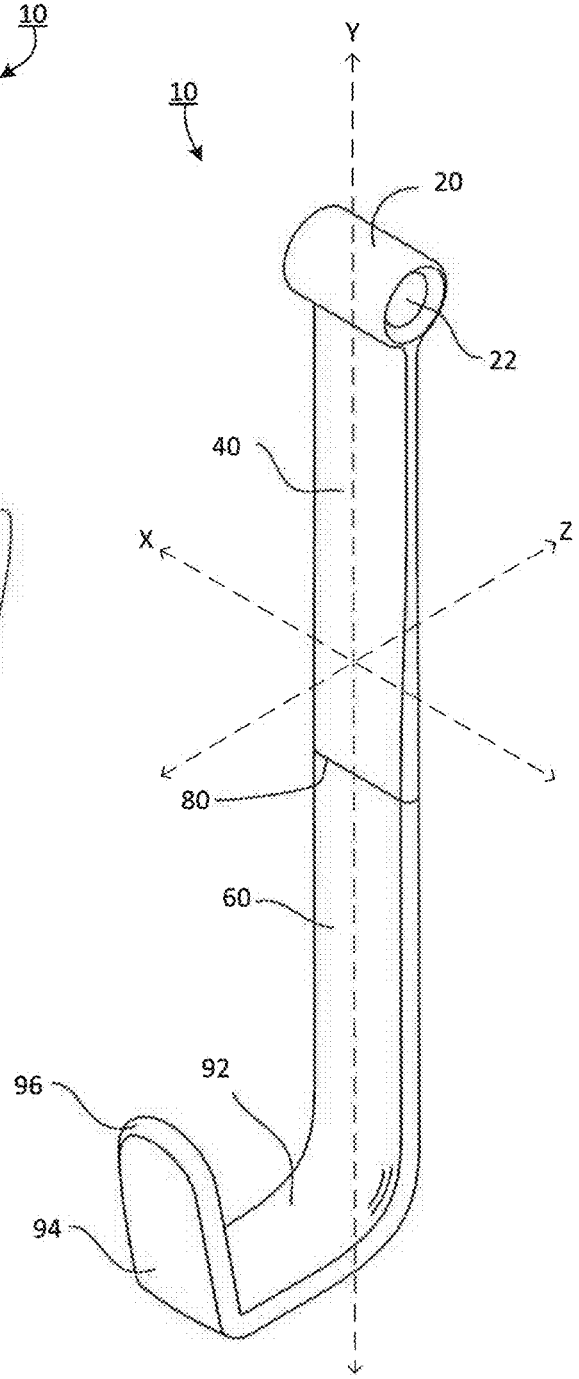
FIG. 2 depicts an upper perspective view of the toilet.

FIG. 2 shows the lower body 60 further including a support portion 92, a hook return 94 and a hook end 96. The support portion is of a sufficient width and length to properly hold a child's seat cover 1 and/or other items to be stored near the toilet 30. The hook return 94 is of a sufficient height to properly secure the child's seat cover 1 and prevent the child's toilet seat cover 1 from falling off of the device or toilet hook 10.

The hook end 96 extends into a narrowing arc or curved end to allow for simple access in installing and removing the child's toilet seat cover 1. However, it is to be understood that the hook end 96 can take any suitable shape to allow for installing and removing the child's toilet seat cover. For example, the hook end 96 may instead have a wider end to provide further security of the child's toilet seat cover.

Figure 3:
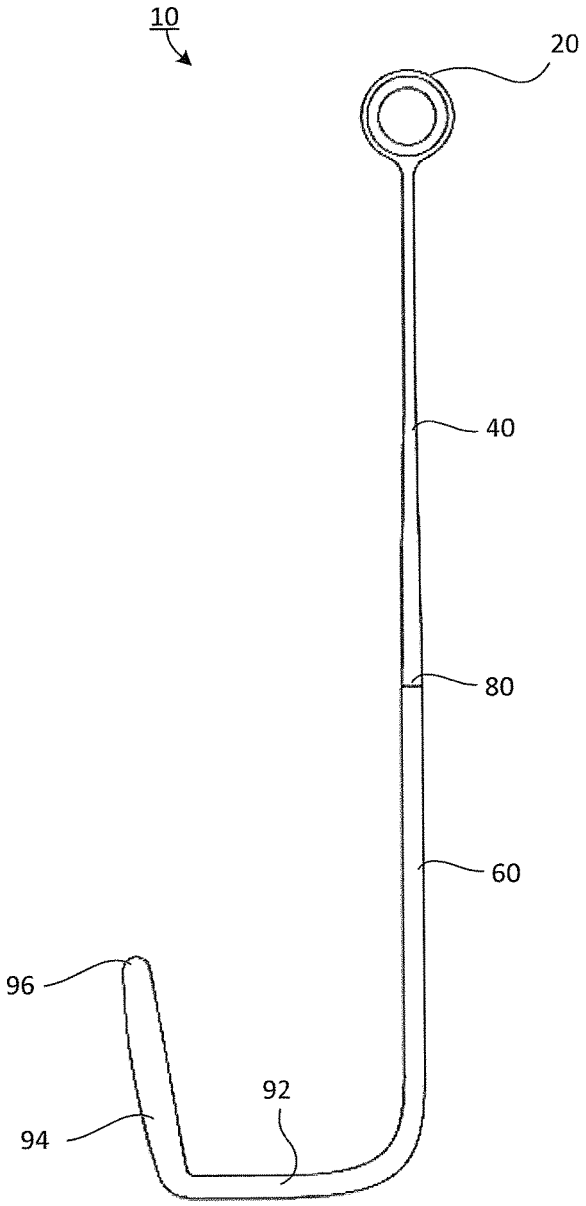
FIG. 3 illustrates a side view of the toilet hook.

FIGS. 1-3 show that the lower body 60 may be made of a rigid material. In an embodiment, the lower body 60 is made of polypropylene (PP), but it is to be understood that the lower body 60 may be made of any rigid material that is able to support the weight of a child's toilet seat cover or other item. Suitable alternatives include, but are not limited to, polyvinyl chloride (PVC), stainless steel, wood and other similar rigid material.

Figure 17:
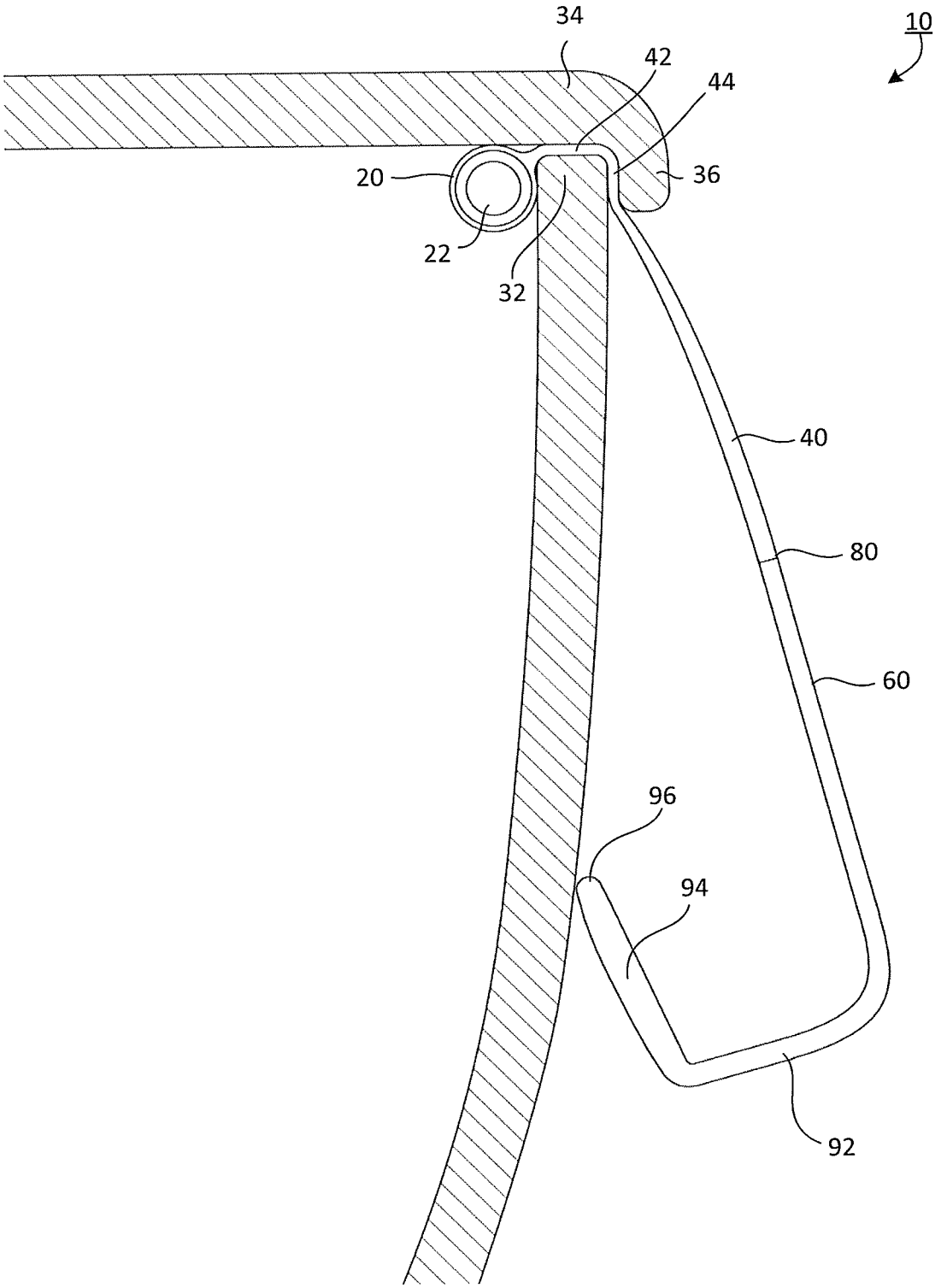
FIG. 17 shows the toilet hook in another installed position.

FIG. 1 also shows that the toilet hook 10 can be installed on the toilet in between the toilet tank 32 of the toilet 30 and the toilet tank cover 34 of the toilet 30. To properly install the toilet hook 10, the upper body 40 is placed adjacent to an outside of the toilet tank 32, while the stopper 20 is placed on an inside of the toilet tank 32 under the toilet tank cover 34. The toilet tank cover 34 is then placed on top of the upper body 40, creating a pinched uppermost portion 42 under the weight of the toilet tank cover 34. The compression of the pinched uppermost portion 42 between the toilet tank 32 and the toilet tank cover 34 provides for a friction grip sufficient to withstand gravitational forces of a weight of a child's toilet seat cover resting on the toilet hook 10. The stopper 20 has a thickness that is wedged up against the toilet tank cover 34 and the toilet tank 32 that further prevents the toilet hook 10 from becoming dislodged from a secured position. A toilet tank cover end 36 further pinches an adjacent downturned pinched portion 44 of the upper body 40, allowing the remainder of the upper body 40 to remain upright and secured. FIG. 17 further illustrates the toilet hook 10 can be installed in reverse. That is, instead of the support portion 92 facing outwards away from the toilet tank 32, the support portion 92 faces inwards toward the toilet tank 32. This positioning results in further securement for the child's toilet seat cover 34.

Figure 6:
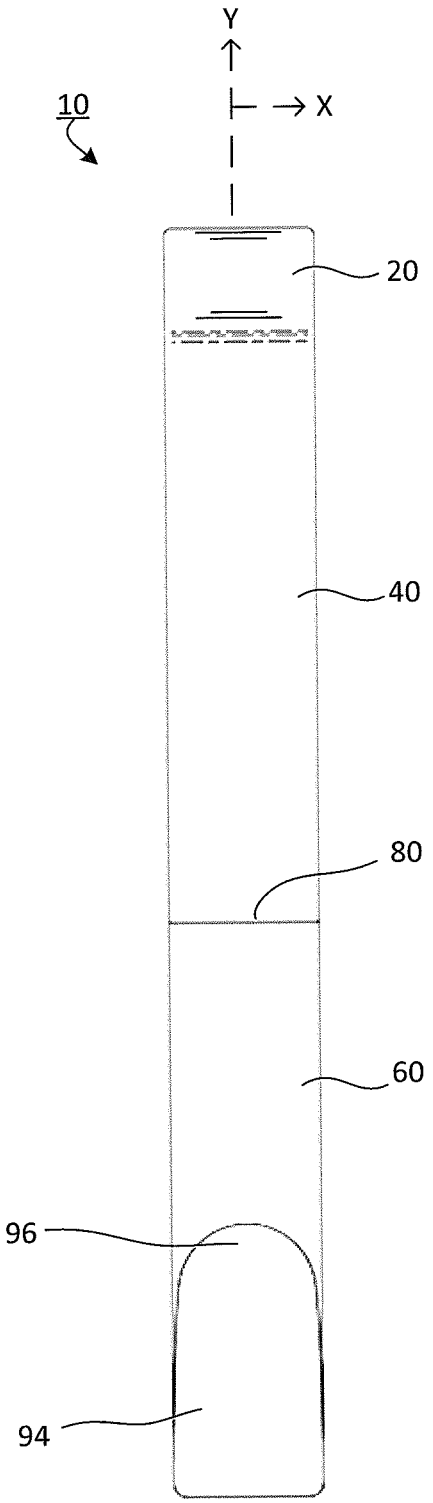
FIG. 6 shows a front view of the toilet hook.
Figure 7:
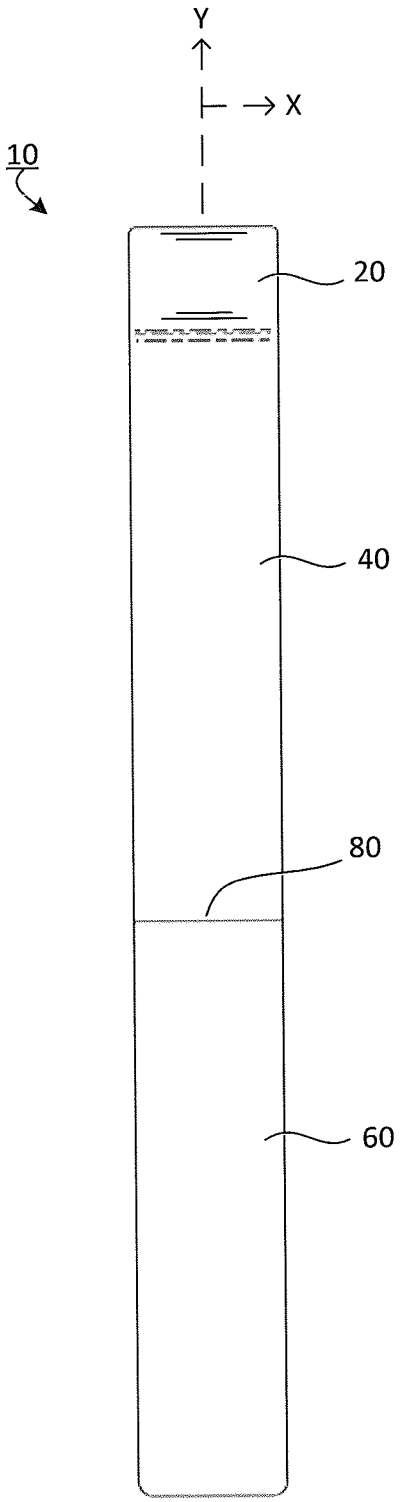
FIG. 7 depicts a back view of the toilet hook.
Figure 8:
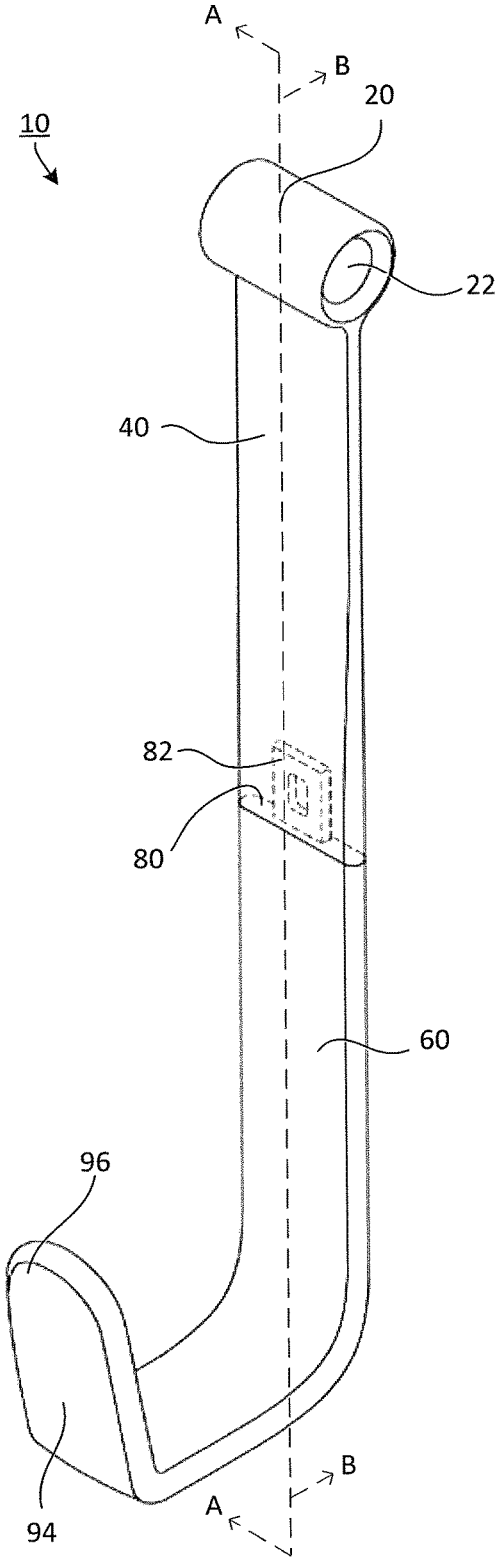
FIG. 8 shows an X-ray isometric view of a connection of the toilet hook.
Figure 9:
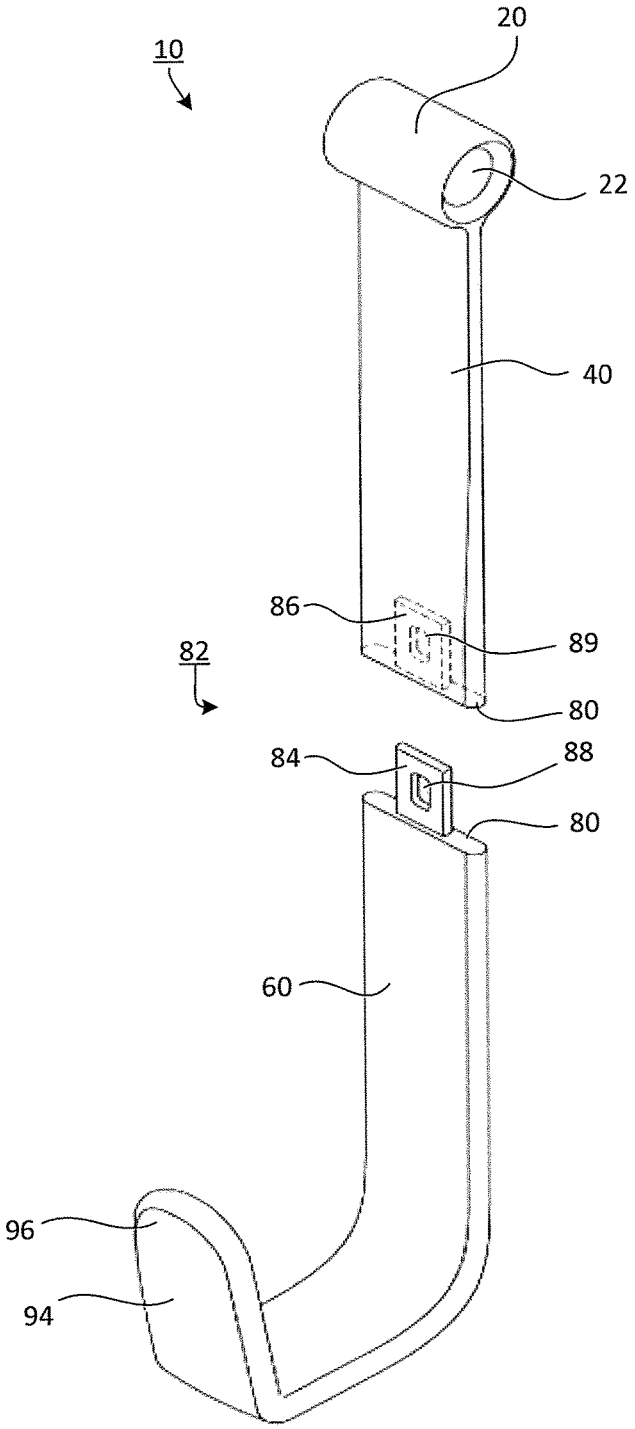
FIG. 9 depicts an exploded partial X-ray isometric view of the connection of the toilet hook.

FIGS. 2 and 6-7 show the upper body 40 and the lower body 60 are aligned along a Y-axis. Although the upper body 40 and the lower body 60 are shown to have similar widths along an X-axis, it is to be understood that the widths of the upper body 40 and the lower body 60 may be varied for other designs. The hook support portion 92 extends outwards from the lower body 60 substantially along a Z-axis.

FIGS. 1-2 and 8-11 illustrate the upper body 40 is connected to the lower body 60 at a junction 80. Although shown in FIGS. 2-3 as a straight plane along the x-z plane, the junction 80 may take any suitable shape that connects the upper body 40 and the lower body 60, including, but not limited to, zig-zag, wavy, triangular and/or other geometric shapes.

Figure 4:
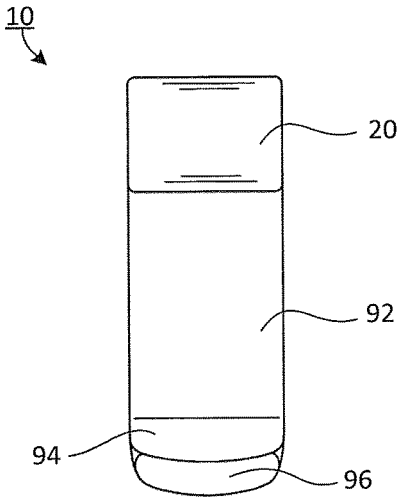
FIG. 4 depicts a top view of the toilet hook.
Figure 5:
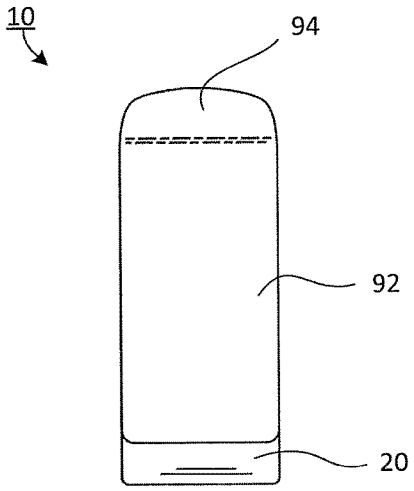
FIG. 5 illustrates a bottom view of the toilet hook.

FIGS. 3-5 show the hook return 94 leans and/or extends out in a nearly perpendicular orientation in relation to the support portion 92. The orientation allows for easier installation and removal of the child's toilet seat cover. However, it is to be understood that the hook return 94 may be constructed at any suitable angle to provide access to the holding portion. For example, the hook return 94 may be substantially perpendicular to the support portion 92 to provide a combination of securement and ease of access. It is also possible for the hook return 94 to be biased further inwards toward the lower body 60 and over the support portion 92 to provide more securement. Alternatively, the hook return 94 may be biased further outwards and away from the support portion 92 and/or the lower body 60 to provide even easier access. Therefore, the orientation of the hook return 94 in relation to the holding portion 94 can be designed in a variety of different configurations for securement and/or ease of access.

FIGS. 6-7 depict the stopper 20, the upper body 40 and the lower body 60 are all of similar widths. The widths are similar and convenient for storage and a streamlined design. However, it is to be understood that any combination of suitable widths may be used to properly secure a child's toilet seat cover.

In FIGS. 8-11, the upper body 40 and the lower body 60 are attached at the junction 80 via a connection mechanism 82. The connection mechanism 82 is depicted as a male portion 84 and a female portion 86. The male portion 84 may be aligned central to the female portion 86. The male portion 84 fits completely within and is surrounded by the female portion 86. As further shown, the male portion 84 has a cavity 88. During an overmold process, the female portion 86, fills the cavity 88 with a cavity filling 89 that is overmolded onto the male portion 84.

In particular, in production, the upper body 40 can be overmolded or comolded, such that the upper body 40 and the lower body 60 become one integral piece. Although the male portion 84 and the female portion 86 are depicted on the lower body 60 and the upper body 40, respectively, it is to be understood that the male portion 84 and the female portion 86 of the connection mechanism 82 may be of any orientation and/or position that provides suitable fastening and securement of the upper body 40 and the lower body 60.

Figure 10:
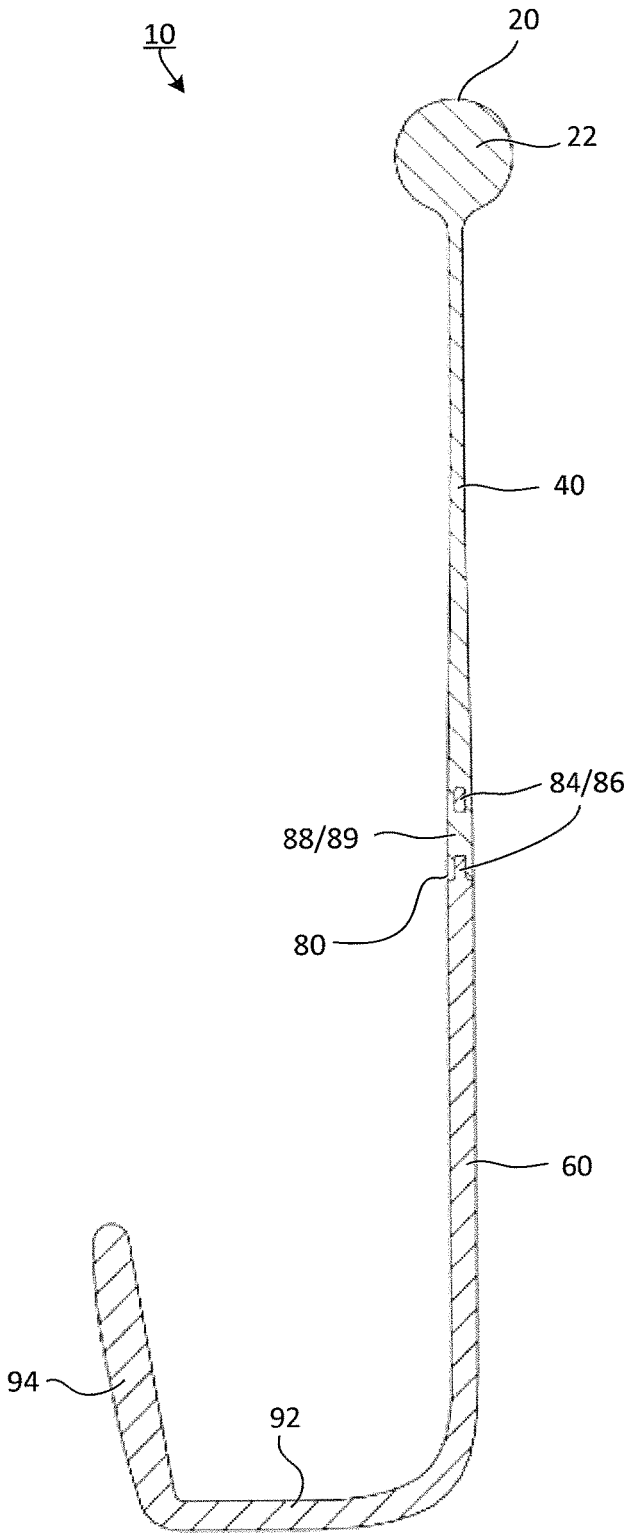
FIG. 10 illustrates the A-A cross sectional view of FIG. 8.
Figure 11:
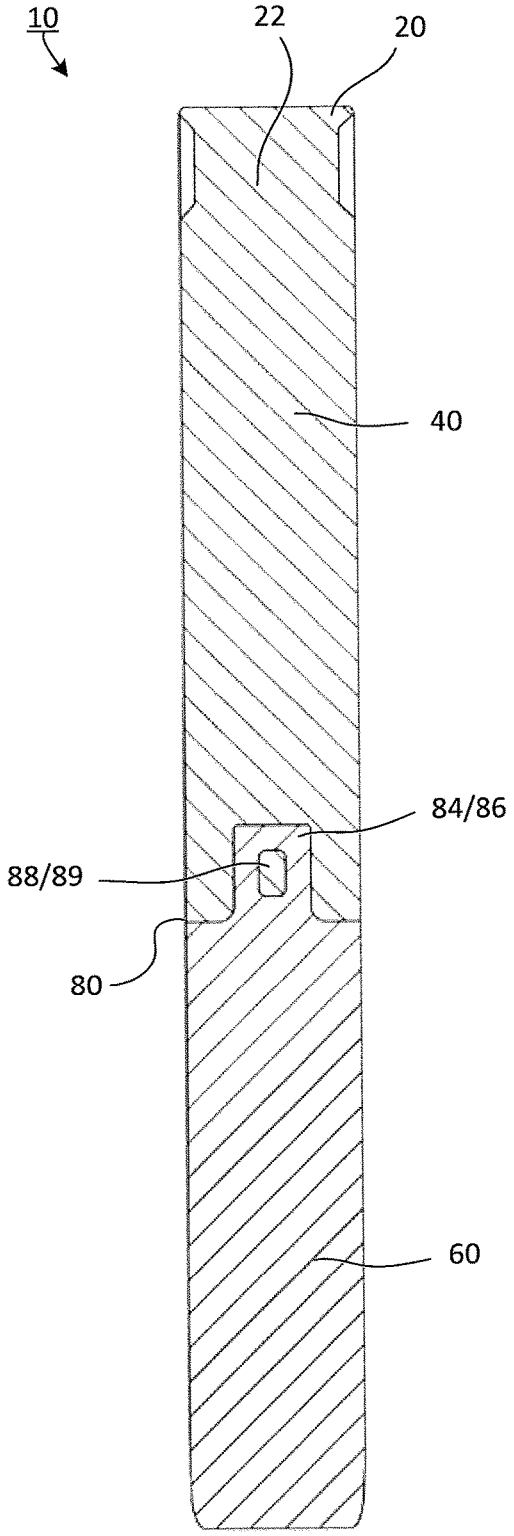
FIG. 11 shows B-B cross sectional view of FIG. 8.
Figure 12:
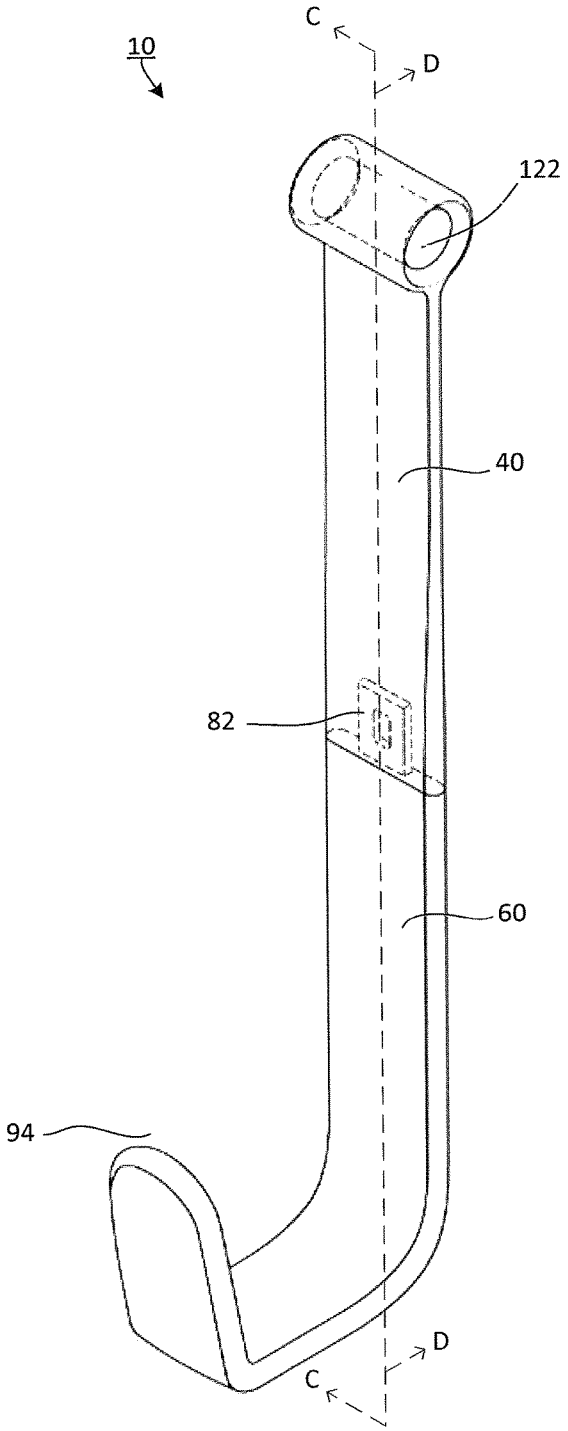
FIG. 12 depicts an X-ray isometric view of a second embodiment of the toilet hook having a removable intermediate portion.
Figure 13:
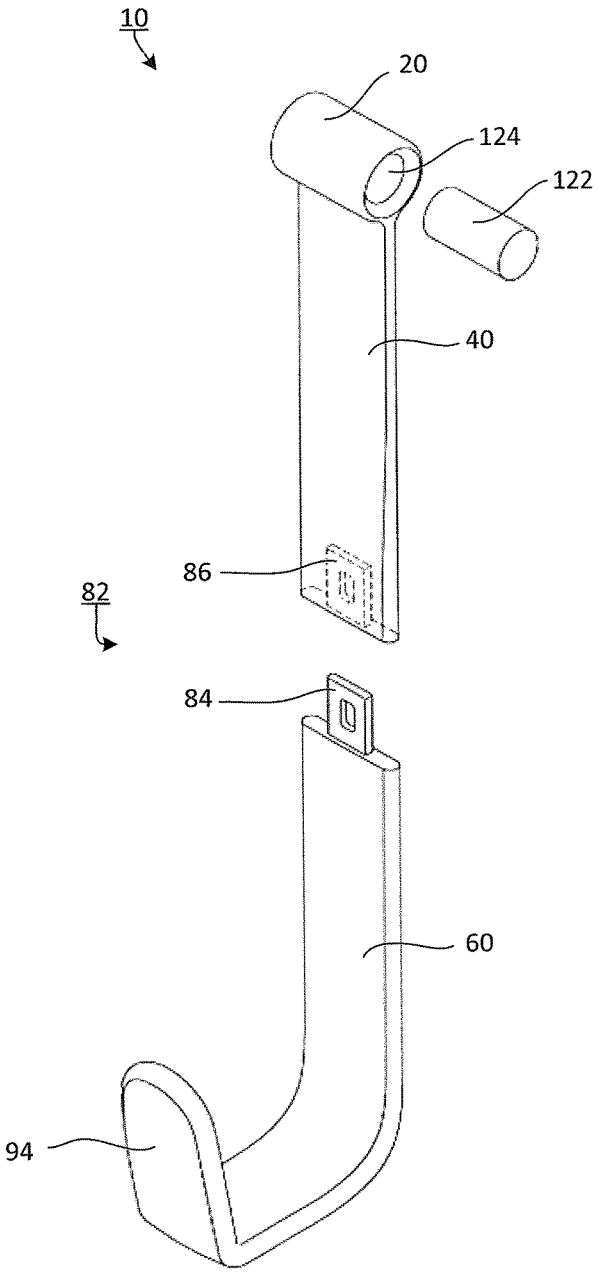
FIG. 13 shows an exploded partial X-ray isometric view of the second embodiment of the toilet hook.
Figure 14:
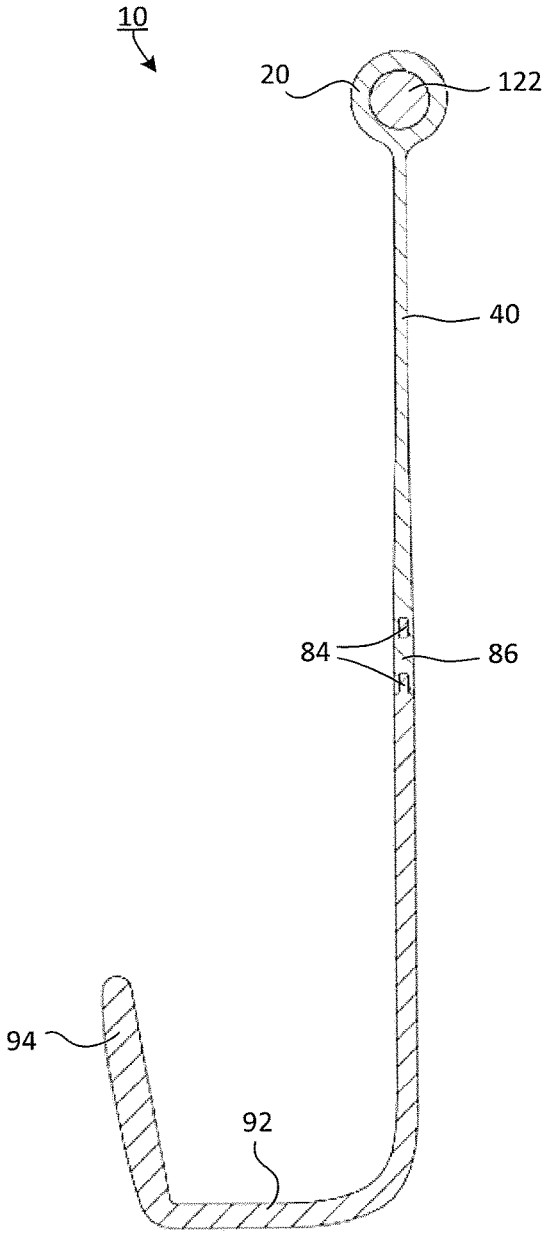
FIG. 14 shows the C-C cross sectional view of FIG. 12.
Figure 15:
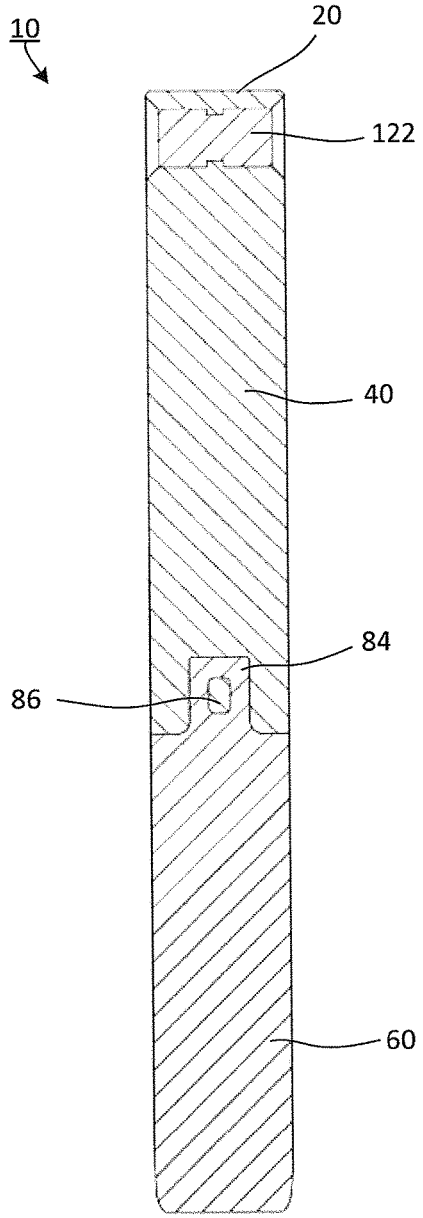
FIG. 15 shows the D-D cross sectional view of FIG. 12.

FIGS. 10-11 depict the stopper 20 as a solid member that is cylindrical in shape. An intermediate portion 22 is shown to be narrower in width in comparison to the stopper 20. It is to be understood that any width can be utilized for design purposes.

FIGS. 12-15 contemplate another embodiment of the toilet hook 10. The stopper 20 contains a removable intermediate portion 122 housed inside of a stopper cavity 124. The removable intermediate portion 122 can be removed and installed to make the stopper heavier, more rigid and/or lighter and also to create different structural, characteristics or designs. For example, different color removable intermediate portion 122 can be installed to create a more favorable combination of colors. Although shown as narrower in width in comparison to the stopper 20, the removable intermediate portion 122 may be of any width to provide further artistic creativity.

Figure 16:
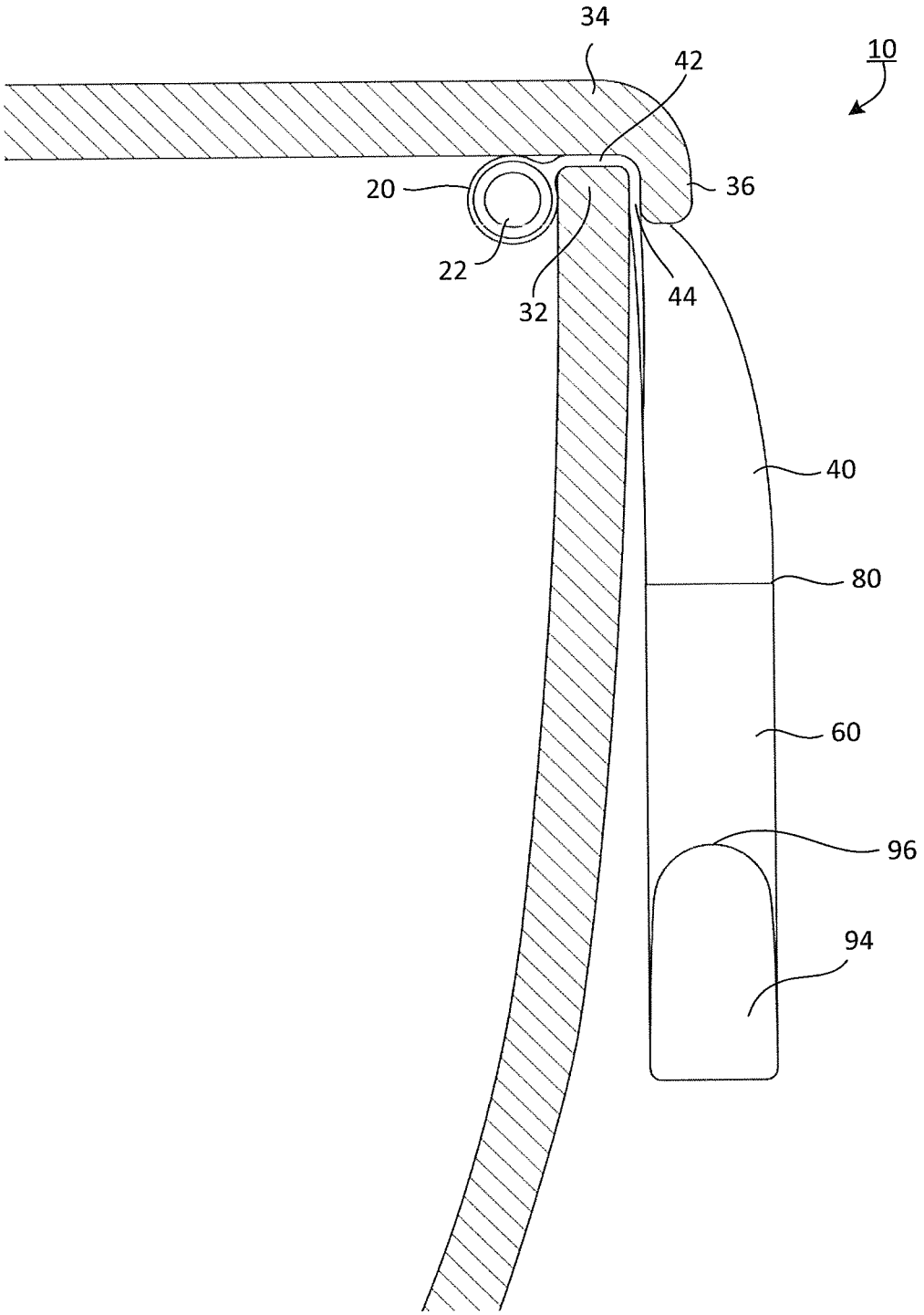
FIG. 16 shows the toilet hook in a twisted position.

FIG. 16 depicts the flexibility of the toilet hook 10 in a twisted position. Due to the flexible material of the upper body 40, the toilet hook 10 may be twisted. The twisting allows for easy access to the hook 90 of the toilet hook 10. For example, in situations in which the toilet 30 is in a tight confined space such as near a cabinet or some other immovable object, the flexible nature of the upper body 40 allows for the hook 10 to be twisted to secure the child's toilet seat cover 1 in a forward or other direction. After use, the hook 10 can be uncoiled to the original installed position and store the toilet seat cover with no hassle. To remove the seat cover 1, the toilet hook 10 could simply be guided towards the user and twisted to allow access to the hook 90, from which the user can remove the toilet seat cover 1 with no hassle or obstruction by neighboring objects.

FIG. 17 shows an alternate installed position for the toilet hook 10. As before, the stopper 20 remains secured underneath the toilet tank cover 34. The hook 90 of the toilet hook 10 faces inwards toward the toilet 30. This allows for further securement of the object being held because the weight of the object pulls the lower body 60 inwards and up against the toilet 30. Therefore, it less likely for an object to slip over and fall off of the hook end 96.

Figure 18:
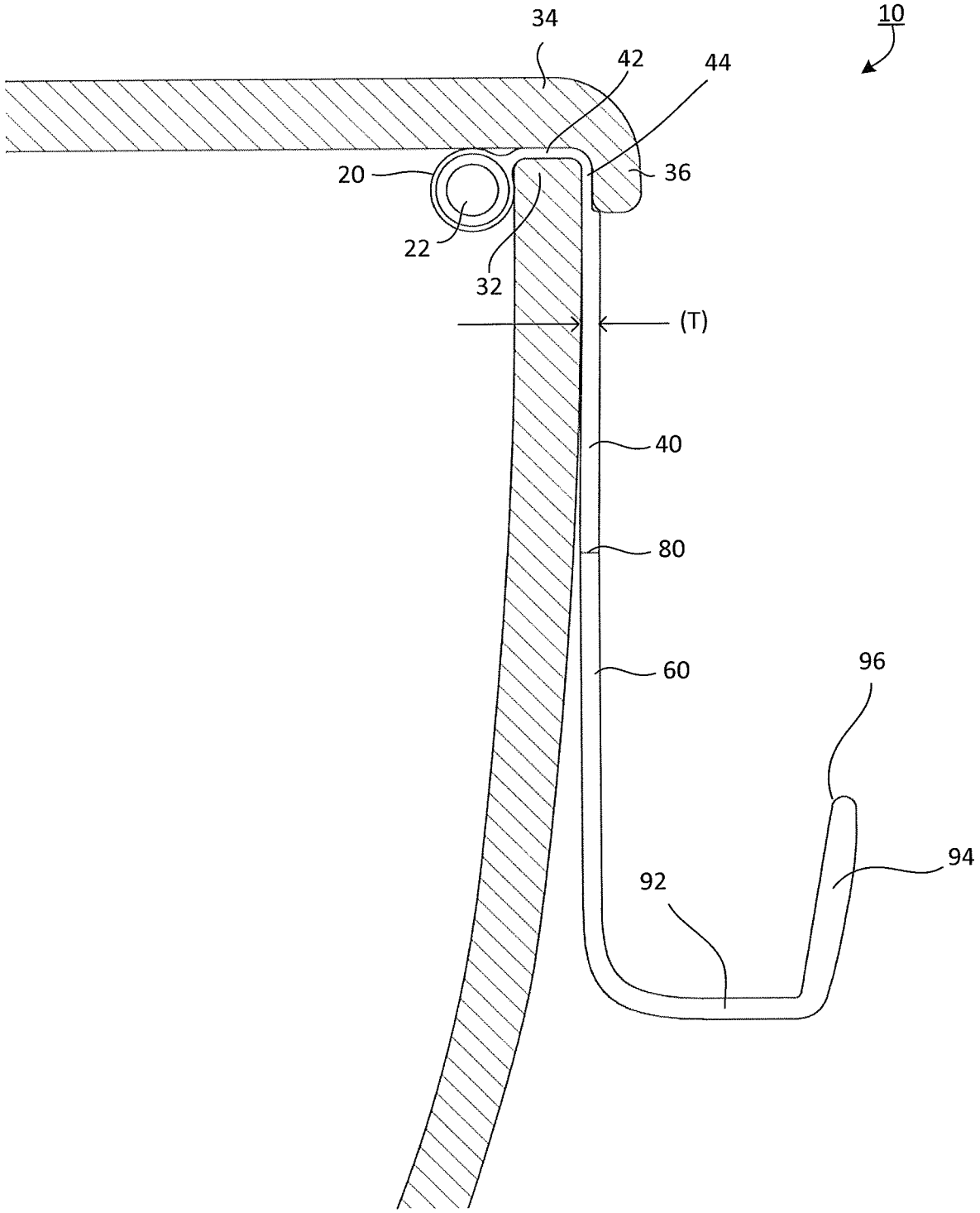
FIG. 18 shows a third embodiment of the toilet hook in an installed position.

FIG. 18 shows another embodiment in which the upper body 40 may be constructed of a wider thickness (T) than the pinched uppermost portion 42 and/or the adjacent pinched portion 44. The wider thickness (T) can be measured along a z-axis similar to the z-axis shown in FIG. 2. This allows for increased durability overall and a tighter friction fit. It is to be understood, however, that the upper body 40, the pinched uppermost portion 42 and the adjacent pinched portion 44 may be of any suitable varying thickness. For example, the pinched uppermost portion 42 may also be of a wider thickness than the upper body 40 for increased durability of the specific portion being pinched.

Figure 19:
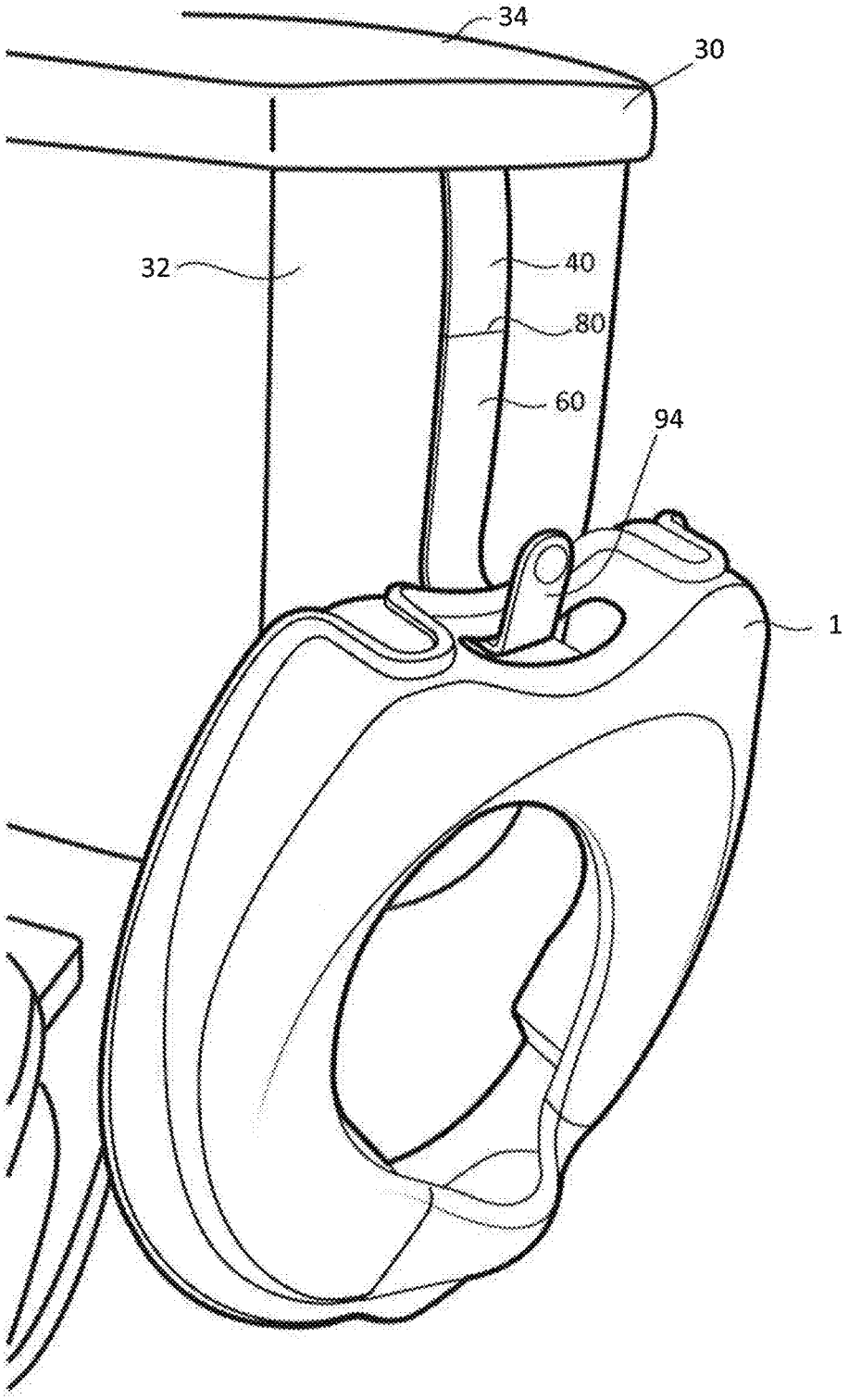
FIG. 19 shows the toilet hook in an installed position with a child's toilet seat cover disposed thereon.

FIG. 19 shows the toilet hook 10 in an installed position with the toilet seat cover 1 installed. As similarly shown in FIGS. 1 and 16-18, the upper body 40 is held in place by having the pinched uppermost portion 42 disposed between the toilet tank 32 and the toilet tank cover 34. The toilet seat cover 1 can rest on support portion 92. The hook return 94 prevents the toilet seat cover 1 from falling off therefrom.

Other embodiments of the toilet hook 10 contemplate the upper body 40 and the lower body 60 removably attached at the junction 80. The connection mechanism 82 would contain a buckle-like male portion 84 and a cavity-like female portion 86. The male portion 84 would further have a button-like structure that would allow the male portion 84 to come from the female portion 86. Other similar securing mechanisms may be used for the connection mechanism 82, such as screw-on, clasp or the like.

The illustrations and examples provided herein are for explanatory purposes and are not intended to limit the scope of the appended claims. It will be recognized by those skilled in the art that changes or modifications may be made to the above described embodiment without departing from the broad inventive concepts of the invention. It is understood therefore that the invention is not limited to the particular embodiment which is described but is intended to cover all modifications and changes within the scope and spirit of the invention.

What is claimed:

1. A device for hanging an item comprising:

a first section;

a stopper attached to a first end of the first section, the stopper being larger in at least one dimension than a remainder of the first section such that the stopper anchors the device while hanging;

a second section connected to a second end of the first section; and a hook adjacent to the second section, where, in use, the first section can be rotated relative to the second section along a longitudinal axis.

2. The device recited in claim 1 wherein the first section is comprised of a first material and the second section is comprised of a second material.

3. The device recited in claim 2 wherein the first material is resilient, the second material is rigid, and the rotation of the first section with respect to the second section is accomplished by the twisting of the first section.

4. The device recited in claim 1 wherein the first section and the second section are secured via a connection mechanism.

5. The device recited in claim 4 wherein the connection mechanism is adapted to removably connect first and second sections.

6. The device recited in claim 1 wherein a portion of the first section is thicker than a remaining portion of the first section.

7. The device recited in claim 1 wherein a portion of the first section is disposed between a toilet tank and a toilet tank cover and the stopper is adjacent to both the toilet tank and the toilet tank cover when in an installed position.

8. The device recited in claim 1 wherein the first section and the second section are substantially aligned along the longitudinal axis.

9. A device for storing a child's toilet seat cover comprising:

a body;

a stopper attached to a first end of the body, the stopper being larger in at least one dimension than a remainder of the body such that the stopper anchors the device while hanging; and a hook attached to a second end of the body, where, in use, the body can be twisted relative to the hook along a longitudinal axis.

10. The device recited in claim 9 wherein the body is comprised of a first material and the hook is comprised of a second material.

11. The device recited in claim 10 wherein the first material is resilient and the second material is rigid.

12. The device recited in claim 9 wherein the body and the hook are secured via a connection mechanism.

13. The device recited in claim 12 wherein the connection mechanism is adapted to removably connect the body and hook.

14. The device recited in claim 9 wherein a portion of the body is thicker than a remaining portion of the body.

15. A hook device for hanging an item comprising:

a flexible first section connected to a second section, both sections extending along a longitudinal axis;

a stopper attached to a first end of the first section that is a single solid body, thicker than a remainder of the first section such that the stopper anchors the device while hanging; and a hook adjacent to a second end of the second section, where, in use, the first section flexibly twists relative to the second section along the longitudinal axis.

16. The device recited in claim 15 wherein the first section is comprised of a first material and the second section is comprised of a second material.

17. The device recited in claim 16 wherein the first material is resilient and the second material is rigid.

18. The device recited in claim 15 wherein the first section and the second section are secured via a connection mechanism.

19. The device recited in claim 18 wherein the connection mechanism is adapted to removably connect the first and second sections.

20. The device recited in claim 15 wherein a portion of the first section is thicker than a remaining portion of the first section.

* * * * *